US008943834B2

(12) United States Patent
Koyama et al.

(10) Patent No.: US 8,943,834 B2
(45) Date of Patent: Feb. 3, 2015

(54) PRE-MIXING INJECTOR WITH BLADELESS SWIRLER

(71) Applicants: Masamichi Koyama, Niigata (JP); Shigeru Tachibana, Tokyo (JP)

(72) Inventors: Masamichi Koyama, Niigata (JP); Shigeru Tachibana, Tokyo (JP)

(73) Assignees: Niigata Power Systems Co., Ltd., Tokyo (JP); Shigeru Tachibana, Tokyo (JP)

( * ) Notice: Subject to any disclaimer, the term of this patent is extended or adjusted under 35 U.S.C. 154(b) by 16 days.

(21) Appl. No.: 13/682,118

(22) Filed: Nov. 20, 2012

(65) Prior Publication Data

US 2014/0137556 A1 May 22, 2014

(51) Int. Cl.

| | |
|---|---|
| ***F02C 1/00*** | (2006.01) |
| ***F02G 3/00*** | (2006.01) |
| ***F23R 3/28*** | (2006.01) |

(52) U.S. Cl.

CPC ..... *F23R 3/286* (2013.01)
USPC ..... 60/748; 60/740; 60/737

(58) Field of Classification Search

USPC ..... 60/737, 740, 742, 743, 748; 431/354
See application file for complete search history.

(56) References Cited

U.S. PATENT DOCUMENTS

| | | | | |
|---|---|---|---|---|
| 3,703,259 | A | 11/1972 | Sturgess et al. | |
| 4,271,675 | A | 6/1981 | Jones et al. | |
| 5,540,056 | A * | 7/1996 | Heberling et al. | 60/737 |
| 6,151,899 | A | 11/2000 | Park | |
| 7,926,281 | B2 | 4/2011 | Commaret et al. | |
| 8,656,721 | B2 | 2/2014 | Matsumoto et al. | |
| 2002/0162333 | A1 * | 11/2002 | Zelina | 60/776 |
| 2005/0175948 | A1 | 8/2005 | Pennell et al. | |
| 2005/0241319 | A1 * | 11/2005 | Graves et al. | 60/776 |
| 2010/0050646 | A1 * | 3/2010 | Lovett et al. | 60/742 |
| 2010/0146983 | A1 * | 6/2010 | Hellat et al. | 60/772 |

(Continued)

FOREIGN PATENT DOCUMENTS

| | | | |
|---|---|---|---|
| EP | 1873455 | A1 | 1/2008 |
| EP | 2407720 | A2 | 1/2012 |
| FR | 2406726 | A1 | 5/1979 |

(Continued)

OTHER PUBLICATIONS

Japan Patent Office, "Office Action for JP 2011-117086," Aug. 26, 2014.

(Continued)

*Primary Examiner* — Phutthiwat Wongwian
*Assistant Examiner* — William Breazeal
(74) *Attorney, Agent, or Firm* — Manabu Kanesaka

(57) ABSTRACT

A gas turbine combustor includes a combustion cylinder, a premixing tube, and a pressure injection unit. Holes are formed in a peripheral wall of the premixing tube in a tangential direction. An inner wall is provided in the peripheral wall while having a gap therefrom. The compressed air in the gap forms a swirl flow. The compressed air and injected fuel supplied into the inner wall form straight flows each with a predetermined cross-section area in the inner wall under no influence of the swirl flow. They are combusted in the combustion cylinder via a protruding wall. The flame is stably retained at an appropriate position apart from the top portion of the combustion cylinder to improve durability without being excessively heated. This may prevent deterioration in durability of the combustion cylinder by the heat by retaining the flame at the appropriate position in the combustion cylinder.

12 Claims, 2 Drawing Sheets

(56) References Cited

U.S. PATENT DOCUMENTS

| | | | |
|---|---|---|---|
| 2012/0011854 | A1 | 1/2012 | Khan et al. |
| 2014/0090382 | A1 | 4/2014 | Sandelis et al. |

FOREIGN PATENT DOCUMENTS

| | | | |
|---|---|---|---|
| JP | H07-305849 | A | 11/1995 |
| JP | H11-337069 | A | 12/1999 |
| JP | 2002-227749 | A | 8/2002 |
| JP | 2002-323221 | A | 11/2002 |
| JP | 2009-198054 | | 9/2009 |
| JP | 2010-216668 | A | 9/2010 |
| WO | 2012/156631 | A1 | 11/2012 |

OTHER PUBLICATIONS

Europe Patent Office, "Search Report for EP 12194022.5," May 8, 2013.

* cited by examiner

PRE-MIXING INJECTOR WITH BLADELESS SWIRLER

TECHNICAL FIELD

The present invention relates to a gas turbine combustor. More particularly, the present invention relates to a gas turbine combustor configured to generate an air swirl flow inside a premixing tube connected to and communicated with a combustion cylinder, and to secure a region where straight flows of air and fuel are generated so as to prevent deterioration in durability of the combustion cylinder by stably retaining a flame at an appropriate position in the combustion cylinder, and simultaneously, to realize stabilization of combustion and low emission.

BACKGROUND ART

Japanese Unexamined Patent Application Publication No. 2009-198054 discloses a gas turbine combustor 1 provided with a combustion cylinder 2, a premixing tube 3, and a fuel supply unit 5. The gas turbine combustor 1 is configured to allow the fuel supply unit to supply the fuel to an annular fuel passage 16 along a tangential direction so that the fuel is uniformly injected through an annular nozzle portion 19. The injected fuel is atomized by air from a circumferential air passage 22 that surrounds the nozzle portion, and an axial flow is generated in the combustor. Meanwhile, air flowing inside through holes 25 in a peripheral wall surface of the premixing tube generates a swirl flow that surrounds the axial flow within the combustor. As a result, the flame is retained at a position apart from a top portion of the combustion cylinder so that a heat shield plate 6 is not excessively heated, resulting in improved durability. The resultant gas turbine combustor has durability higher than that of generally employed type, and improved emission characteristics.

However, the aforementioned generally employed gas turbine combustor has a difficulty in stabilization of the flame resulting from the swirl flow supplied inside through the holes formed in the peripheral wall surface of the premixing tube, which intrudes the premixing tube toward the center to disturb uniformity of the axial flow at the center part of the premixing tube.

The nozzle employed in the generally employed gas turbine combustor also has a problem of insufficient shear force to atomize the liquid film of the air blasted fuel fed from the filmer because the straight air flow only exists around the fuel liquid film.

SUMMARY OF THE INVENTION

It is an object of the present invention to prevent an excessive increase in the flow velocity of the straight flow component by avoiding a decrease in the cross-section area of the straight flows of air and fuel in the premixing tube so that the flame is stably retained at an appropriate position in the combustion cylinder to prevent deterioration in durability of the combustion cylinder by the heat, and atomize the fuel irrespective of the air flow for realization of stabilized combustion and low emission.

A first aspect of the present invention provides a gas turbine combustor which includes a combustion cylinder that combusts a mixture of fuel and air for supply of a combustion gas to a turbine, a premixing tube that mixes the fuel and air supplied from one end side and supplies the mixture into the combustion cylinder from the other end side, the premixing tube including a peripheral wall having a plurality of holes formed therein along a tangential direction, through which the air is allowed to flow, and a cylindrical inner wall provided inside the peripheral wall apart therefrom at a predetermined interval so as to define a cylindrical gap having one end side closed and the other end side communicated with the combustion cylinder between the peripheral wall and the inner wall, and a fuel supply unit attached to the one end side of the premixing tube for supply of the fuel into the premixing tube.

A second aspect of the present invention is the gas turbine combustor according to the first aspect wherein an inner circumferential surface of the inner wall has a straight cylindrical shape.

A third aspect of the present invention is the gas turbine combustor according to the second aspect wherein the fuel supply unit is a pressure injection nozzle of hollow cone type, which injects the fuel in a hollow conical shape.

A fourth aspect of the present invention is the gas turbine combustor according to the third aspect wherein the other end side of the premixing tube is protruded into the combustion cylinder.

A fifth aspect of the present invention is the gas turbine combustor according to the fourth aspect wherein an axial length of the premixing tube is set so that the fuel conically injected through the pressure injection nozzle is not brought into contact with the other end side of the premixing tube.

A sixth aspect of the present invention is the gas turbine combustor according to the fifth aspect wherein an air flow channel is formed around the pressure injection nozzle.

The gas turbine combustor according to the first aspect is configured so that air flowing inside through the holes formed in the peripheral wall of the premixing tube forms a swirl flow in a cylindrical gap between the peripheral wall and the inner wall so as to be fed into the combustion cylinder. Air and fuel are supplied from one end side of the premixing tube into an inner space of the inner wall, which are formed into a mixture. The mixture forms the uniform straight flow along the axial direction of the inner wall over an entire region inside the inner wall under no influence of interference of the swirl flow, and is supplied into the combustion cylinder for combustion. The straight flow of the mixture in the premixing tube secures the uniform cross section area as the one inside the peripheral wall without any disturbance of the uniform axial flow at the center of the premixing tube owing to intrusion of the air swirl flow through the holes in the peripheral wall of the premixing tube. Therefore, the flame is stably retained at the appropriate position in the combustion cylinder so as to prevent deterioration in durability of the combustion cylinder by the heat and to realize stabilized combustion and low emission.

The inner wall of the gas turbine combustor according to the second aspect, owing to the effect of the gas turbine combustor according to the first aspect, has the straight cylindrical inner circumferential surface. Compared to the structure with the inner wall having a nozzle-like inner circumference surface protruding inward, the gas turbine combustor according to the invention is configured to suppress adhesion of the fuel supplied from the fuel supply unit to the inner wall. As the inner diameter of the inner wall is kept constant, the flow velocity of the mixture is kept at a constant value adequately to hardly fluctuate, resulting in a steady straight flow.

The gas turbine combustor according to the third aspect, owing to the effect of the gas turbine combustor according to the second aspect, has the fuel supply unit formed as the pressure injection nozzle of hollow cone type. This makes it possible to inject the fuel in the hollow cone shape, and to atomize the fuel in good condition irrespective of the air flow.

The gas turbine combustor according to the fourth aspect, owing to the effect of the gas turbine combustor according to the third aspect, is configured so that the other end of the premixing tube protrudes into the combustion cylinder. The fuel injected into the premixing tube is exposed under the high temperature atmosphere in the combustion cylinder so as to promote evaporation.

The gas turbine combustor according to the fifth aspect, owing to the effect of the gas turbine combustor according to the fourth aspect, is configured to prevent the problem of an increase in the temperature at the other end side of the premixing tube caused by the conically injected fuel through the pressure injection nozzle, which is adhered to the other end of the premixing tube and ignited.

The gas turbine combustor according to the sixth aspect, owing to the effect of the gas turbine combustor according to the fifth aspect, is configured to suppress the spread of the conically injected fuel through the pressure injection nozzle by the air from the flow channel provided around the pressure injection nozzle. This makes it possible to further alleviate adhesion of the fuel to the inner wall.

DESCRIPTION OF THE EMBODIMENT

Figure 1:
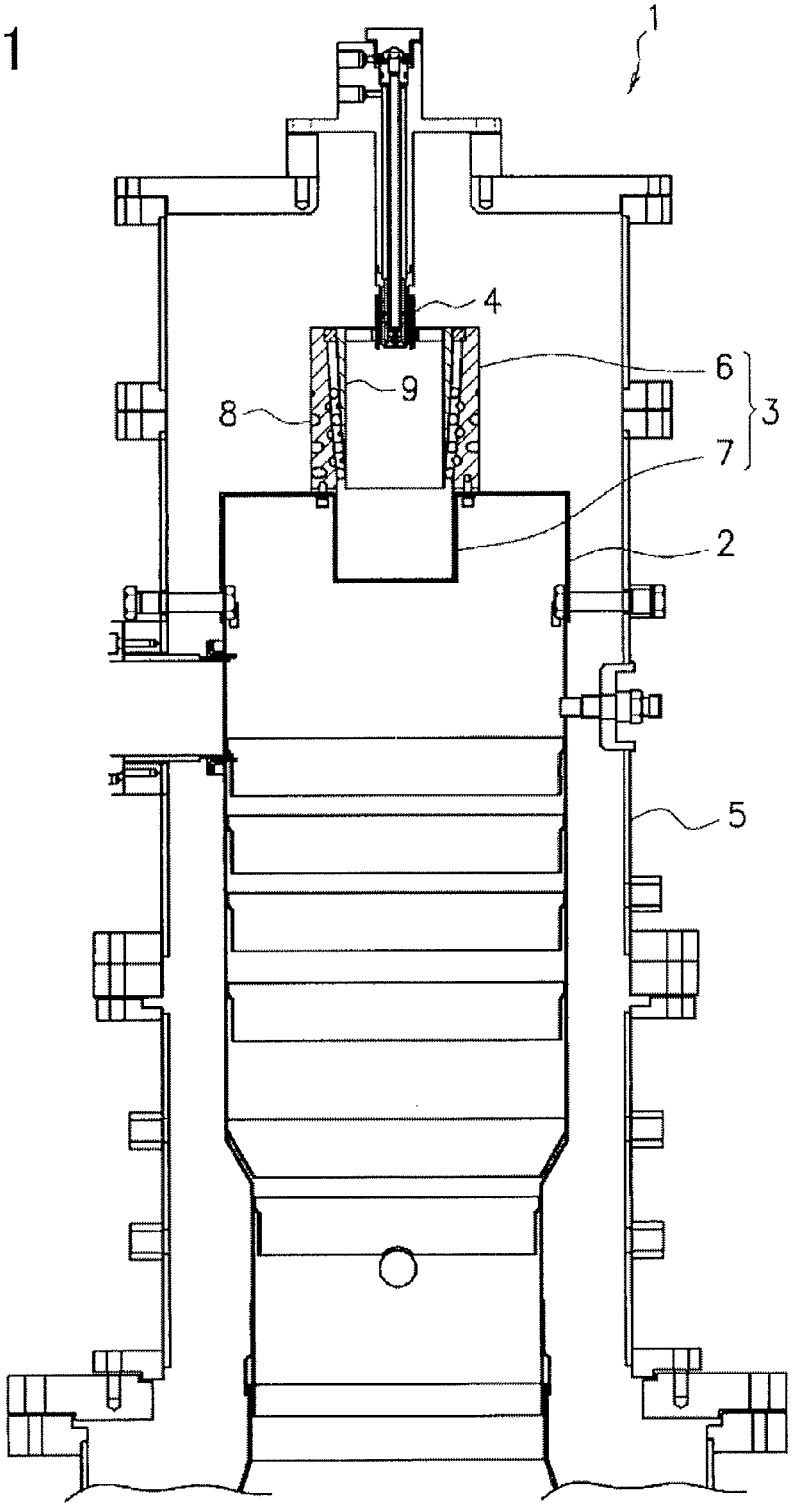
FIG. 1 is a longitudinal sectional view of a gas turbine combustor according to an embodiment of the present invention.

An embodiment of the present invention will be described in detail referring to the drawings.

Referring to FIG. 1, a general structure of a gas turbine combustor 1 according to an embodiment will be described. The gas turbine combustor 1 includes a substantially cylindrical combustion cylinder 2. The combustion cylinder 2 has a top portion closed, and a lower opening communicated with an exhaust side of a not shown gas turbine. The top portion of the combustion cylinder 2 is provided with a premixing tube 3, which will be described in detail later. A top portion of the premixing tube 3 is provided with a pressure injection unit 4 as a fuel supply unit. The combustion cylinder 2 and the premixing tube 3 are encased with an outer cylinder 5 communicated with a compressed air inlet of a turbo-compressor (not shown). A part of a fuel supply system connected to the pressure injection unit 4 is guided to the outside while penetrating the top portion of the outer cylinder 5.

Figure 2:
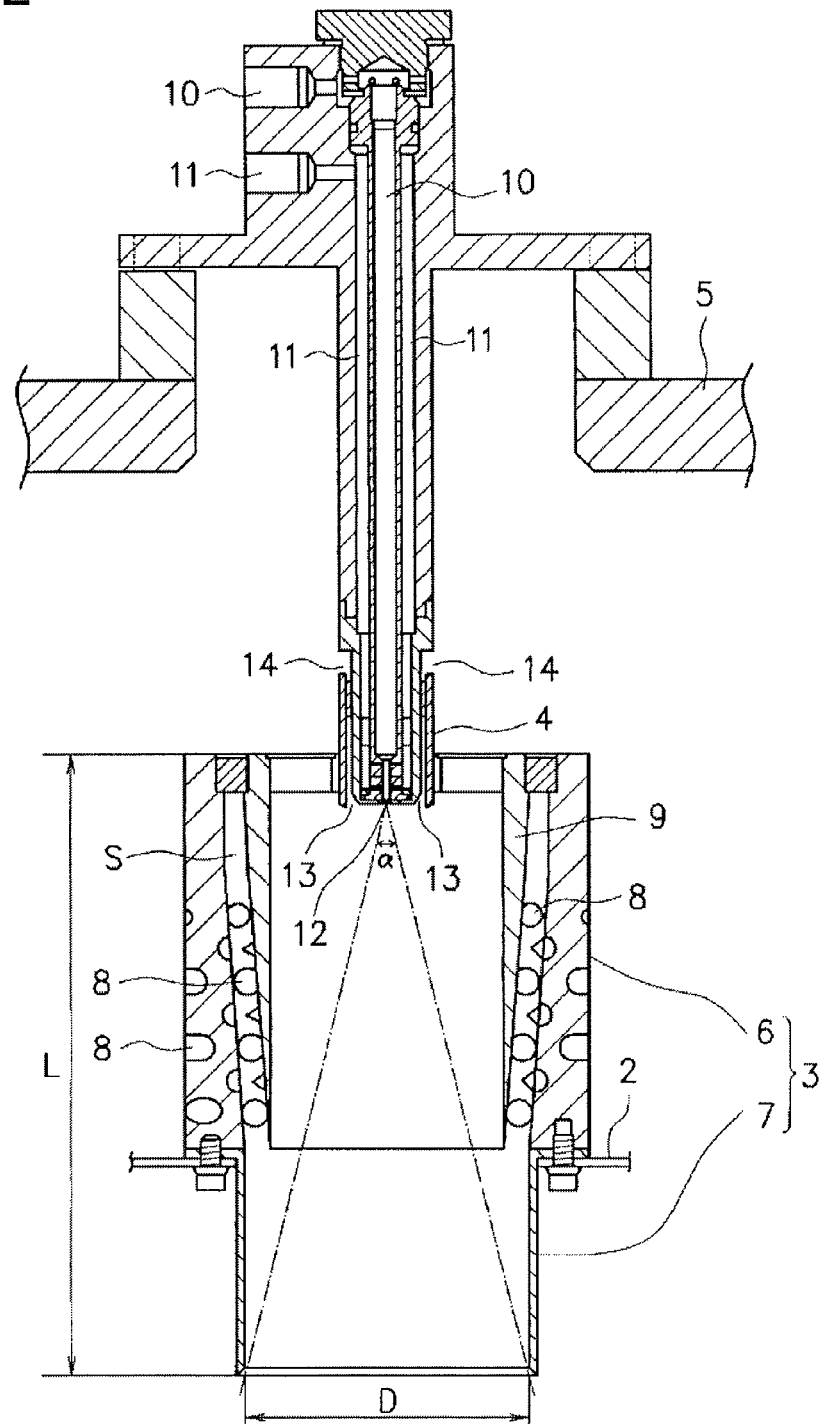
FIG. 2 is an enlarged longitudinal sectional view of a part around a premixing tube of the gas turbine combustor according to the embodiment.

Referring to FIGS. 1 and 2, at the center position of the top portion of the combustion cylinder 2, the premixing tube 3 is coaxially provided. The premixing tube 3 includes a cylindrical peripheral wall 6 provided outside the top portion of the combustion cylinder 2, and a cylindrical protruding wall 7 that is provided at the top portion of the combustion cylinder 2 so as to partially protrude into the combustion cylinder 2 downward by a predetermined dimension. The peripheral wall 6 has a straight cylindrical outer shape, and an inner shape with the inner diameter gradually reduced toward the combustion cylinder 2 in the downward direction. The peripheral wall 6 has a plurality of holes 8 along the tangential direction, which allow air to flow inside. The protruding wall 7 connected to the lower end of the peripheral wall 6 has the straight cylindrical shape with the same inner diameter as that of the opening of the peripheral wall 6 at the lower end.

A cylindrical inner wall 9 is provided inside the peripheral wall 6 of the premixing tube 3 coaxially at a predetermined interval therebetween. An outer circumferential surface of the inner wall 9 has an outer diameter gradually reduced toward the combustion cylinder 2 in the downward direction. The radial distance between the peripheral wall 6 and the inner wall 9 is kept constant, which defines a cylindrical gap S penetrating downward. The gap S has its upper end at one end side of the premixing tube 3 closed, and a lower end opened around the protruding wall 7. The inner circumferential surface of the inner wall 9 has a straight cylindrical shape. The upper end of the inner wall 9 at one end side of the premixing tube 3 is opened to the outer cylinder 5.

The compressed air from the turbo-compressor, which is guided into the outer cylinder 5 flows inside through the holes 8 formed in the peripheral wall 6 of the premixing tube 3, and then forms a swirl flow in the cylindrical gap S between the peripheral wall 6 and the inner wall 9. It is further fed into the combustion cylinder 2 while swirling along the inner circumferential surface of the protruding wall 7. The compressed air is supplied to the inside of the inner wall 9 from the opening at the upper end thereof together with the fuel supplied from the pressure injection unit 4, which are formed into the mixture. The mixture forms the uniform straight flow along the axial direction of the inner wall 9 over the whole region inside thereof under no influence of the interference of the swirl flow. It is then supplied into the combustion cylinder 2.

As shown in FIG. 2, the pressure injection unit 4 is attached to the center of the opening at the upper end of the peripheral wall 6 at one end side of the premixing tube 3. The pressure injection unit is a pressure injection nozzle of hollow cone type, which atomizes liquid fuel in a highly advanced manner by injecting the fuel in a hollow conical shape. The pressure injection unit 4 is configured to discharge the fuel supplied from two fuel supply channels, that is, a main supply channel 10 and a pilot supply channel 11 through one injection nozzle 12. The swirl motion is applied to the fuel so that the fuel discharged through the injection nozzle 12 spreads under centrifugal force to form a hollow cone film. As the pressure injection nozzle of hollow cone type, the simplex injection valve is known.

As shown in FIG. 2, an injection angle $\alpha$ of the injection nozzle 12 of the pressure injection unit 4 is set so that the conically injected fuel is not adhered to the opening at the lower end (lower end of the protruding wall 7) of the premixing tube 3 with the whole axial length of L and inner diameter of D. A flow channel 13 is formed around the pressure injection nozzle, through which the compressed air in the outer cylinder 5 is guided from an inlet 14 so as to be injected. Accordingly, the air from the flow channel 13 serves to suppress spread of the fuel conically injected through the pressure injection nozzle. This makes it possible to further alleviate and suppress adhesion of the fuel to the protruding wall 7.

Operations of the above-structured gas turbine combustor 1 according to the embodiment will be described.

The compressed air from the turbo-compressor is generally at the temperature of approximately 300° C. The compressed air is guided into the outer cylinder 5, flows inside through the holes 8 formed in the peripheral wall 6 of the premixing tube 3, and forms the swirl flow in the cylindrical gap S between the peripheral wall 6 and the inner wall 9. The swirl flow is retained along the inner circumferential surface of the protruding wall 7, and fed into the combustion cylinder 2 so as to prevent adhesion of the flame to an outlet of the protruding wall 7. Meanwhile, the compressed air is also supplied into the inner space of the inner wall 9 from the opening at the upper end of the premixing tube 3, and mixed with the fuel injected from the pressure injection unit 4 to form the mixture as the straight flow. It is fed into the combustion cylinder 2 through the protruding wall 7, and combusted to generate combustion gas at the temperature ranging from 1000 to 2000° C., for example. The aforementioned temperatures of the air and gas are taken as example values.

The compressed air and the fuel, or the mixture thereof in the inner wall 9 form the uniform straight flow along the axial direction of the inner wall 9 over the entire region inside thereof under no influence of the interference of the swirl flow of the compressed air formed in the gap S between the peripheral wall 6 and the inner wall 9. The flow is not forced to reduce the cross-section area by the swirl flow around the protruding wall 7, and is fed into the combustion cylinder 2 for combustion. Uniformity of the straight flow of the mixture in the premixing tube 3 along the axial direction at the center is not disturbed by intrusion of the air swirl flow through the holes 8 formed in the peripheral wall 6 of the premixing tube 3. This may secure the uniformity of the cross-section area inside the peripheral wall as that of the flow channel so that the mixture flow is stably fed into the combustion cylinder 2 at the constant flow velocity. The flame may be stably retained at the appropriate position in the combustion cylinder 2, thus preventing deterioration in durability of the combustion cylinder 2 by the heat, and realizing the stabilized combustion and low emission.

The inner circumferential surface of the inner wall 9 of the gas turbine combustor 1 according to the embodiment has the straight cylindrical shape. This may further alleviate and suppress adhesion of the fuel supplied from the pressure injection unit 4 to the inner wall 9. As a result, the position and state of combustion are further stabilized, thus improving durability of the combustion cylinder 2 and the low emission.

The pressure injection unit 4 of the gas turbine combustor 1 according to the embodiment is formed as the pressure injection nozzle of hollow cone type. This makes it possible to inject the fuel in a hollow conical shape, and to atomize the fuel in good condition as the effect of the nozzle by itself irrespective of the air flow. The resultant synergistic effects allow the combustion state to be further stabilized.

The gas turbine combustor 1 according to the embodiment is configured so that the other end of the premixing tube 3 is protruded into the combustion cylinder 2 as the protruding wall 7. The fuel injected into the premixing tube 3 is exposed to the high temperature atmosphere in the combustion cylinder 2 to facilitate evaporation. Stabilization of the combustion state is expected as a result of the synergistic effects. The effect of reducing the temperature on the surface of the protruding wall 7 by latent heat of vaporization at the inner side of the protruding wall 7 is also expected.

The relationship between the injection angle $\alpha$ of the fuel injected through the pressure injection nozzle, and the whole axial length L and the inner diameter D of the premixing tube 3 is appropriately set so that the conically injected fuel is not adhered to the other end of the premixing tube 3 of the gas turbine combustor 1 according to the embodiment. As described above, in the embodiment, the air swirl flow in the gap S is retained inside the protruding wall 7, which prevents adhesion of the flame to the outlet of the protruding wall 7. The relationship between the shape of the premixing tube 3 and the injection angle of the pressure injection nozzle ensures to further prevent the disadvantage of an increase in the temperature resulting from ignition of the fuel adhered to the other end of the premixing tube 3.

According to the gas turbine combustor 1 of the embodiment, the air from the flow channel 13 provided around the injection nozzle 12 serves to suppress spread of the fuel conically injected through the pressure injection nozzle. This ensures to further prevent adhesion of the fuel to the other end of the premixing tube 3.

The gas turbine combustor 1 according to the embodiment ensures to generate the air swirl flow in the gap S between the premixing tube 3 and the inner wall 9, and secure the constant cross-section area of the flow in the inner space of the inner wall 9 under no interference. This also provides the straight flows of air and fuel at constant flow velocities. This may provide the effect of ensuring mixture of the air and fuel as a whole, and feeding the uniformly mixed mixture into the combustion cylinder 2 at a uniform flow velocity, and implementing the stable combustion with low emission. This never applies an excessive thermal load to the device by ensuring the flame to be retained at the appropriate position apart by the required distance from the top portion of the combustion cylinder 2.

What is claimed is:

1. A gas turbine combustor comprising:

a fuel supply unit injecting a fuel;

a premixing tube arranged outside the fuel supply unit at one end side of the fuel supply unit and including a peripheral wall having an inner wall portion with an inner diameter constantly decreasing toward one end thereof, and a plurality of holes extending inside the peripheral wall along a tangential direction of the inner wall portion to supply air inside the inner wall portion, and a cylindrical inner wall having an opening at each end and provided inside the peripheral wall apart therefrom, said cylindrical inner wall having an inner peripheral surface with a constant diameter, and an outer wall portion with a diameter constantly decreasing toward one end thereof, said outer wall portion facing the inner wall portion to form a predetermined constant interval to thereby define a cylindrical gap between the outer wall portion and the inner wall portion, wherein the peripheral wall and the cylindrical inner wall are connected to block the cylindrical gap at another end of the outer wall portion to thereby form a swirl flow with the air flowing through the plurality of holes in the cylindrical gap, and the fuel supplied from the fuel supply unit and air supplied from another end side of the cylindrical inner wall are mixed to form a mixture; and a combustion cylinder connected to the premixing tube, one opening of the cylindrical inner wall and the cylindrical gap directly facing the combustion cylinder to supply the mixture and the air flowing through the plurality of holes into the combustion cylinder for supply of a combustion gas to a turbine.

2. The gas turbine combustor according to claim 1, wherein an inner circumferential surface of the inner wall has a straight cylindrical shape.

3. The gas turbine combustor according to claim 2, wherein the fuel supply unit is a pressure injection nozzle of hollow cone type, which injects the fuel in a hollow conical shape to supply the mixture in a straight flow directly to the combustion cylinder without being blocked.

4. The gas turbine combustor according to claim 3, wherein the premixing tube further comprises a cylindrical protruding wall protruding into the combustion cylinder at another end side, and the air flowing through the plurality of holes in the cylindrical gap retains in the swirl flow along an inner circumferential surface of the cylindrical protruding wall to prevent adhesion of flame to an outlet of the cylindrical protruding wall.

5. The gas turbine combustor according to claim 4, wherein an axial length of the premixing tube is set so that the fuel conically injected through the pressure injection nozzle is not contacted with the another end side of the premixing tube.

6. The gas turbine combustor according to claim 5, wherein an air flow channel is formed around the pressure injection nozzle.

7. The gas turbine combustor according to claim 1, wherein an inner diameter of the cylindrical gap is constantly reduced in a direction toward another end side of the premixing tube.

8. The gas turbine combustor according to claim 7, wherein the inner diameter of the inner wall portion is constantly reduced in the direction toward one end side of the premixing tube, and an outer diameter of the outer wall portion is constantly reduced in the direction toward the one end side of the premixing tube, such that the predetermined interval between the peripheral wall and the inner wall forming the cylindrical gap is constant.

9. The gas turbine combustor according to claim 4, wherein the peripheral wall, the cylindrical inner wall and the cylindrical gap are located between the fuel supply unit and the protruding wall, and the cylindrical protruding wall is located in the combustion cylinder.

10. The gas turbine combustion according to claim 8, wherein the peripheral wall has a portion having a constant diameter above the inner wall portion, and the inner wall has a portion having a constant diameter above the outer wall portion.

11. The gas turbine combustion according to claim 3, wherein the pressure injection nozzle includes a main supply channel, and a pilot supply channel surrounding the main supply channel to provide swirl motion to the fuel.

12. The gas turbine combustion according to claim 11, wherein the pressure injection nozzle further includes a flow channel around the pilot supply channel to suppress spread of the fuel ejected from the injection nozzle.

* * * * *